United States Patent [19]

Kopena

[11] 4,341,003

[45] Jul. 27, 1982

[54] METHOD AND APPARATUS FOR SEPARATING ROLLS OF WEB MATERIAL

[75] Inventor: David M. Kopena, Grand Rapids, Ohio

[73] Assignee: Owens-Corning Fiberglas Corporation, Toledo, Ohio

[21] Appl. No.: 175,111

[22] Filed: Aug. 4, 1980

[51] Int. Cl.[3] ..... B23P 19/04

[52] U.S. Cl. ..... 29/239; 225/3; 225/97; 225/99; 414/330

[58] Field of Search ..... 225/2, 3, 97–99, 225/103; 29/239; 414/330, 786, 787

[56] References Cited

U.S. PATENT DOCUMENTS 2,753,936 7/1956 MacChesney ..... 225/99 X 3,239,116 3/1966 Hulak ..... 225/3

3,268,135 8/1966 Barradell-Smith ..... 225/96.5 X 3,728,772 4/1973 Coffman ..... 29/239

*Primary Examiner*—Frank T. Yost

*Attorney, Agent, or Firm*—Ronald C. Hudgens; Philip R. Cloutier; Ted C. Gillespie

[57] ABSTRACT

A method and apparatus for separating rolls of web material of the type where two or more rolls are attached at the side edges thereof comprising passing the first roll between an upper and lower conveyor defining a first path of travel, and simultaneously passing each attached roll between additional upper and lower conveyors defining a path of travel for each attached roll, where the path of travel for each roll is sufficiently vertically separated from its immediately adjacent path that the rolls passing therethrough are separated.

16 Claims, 4 Drawing Figures

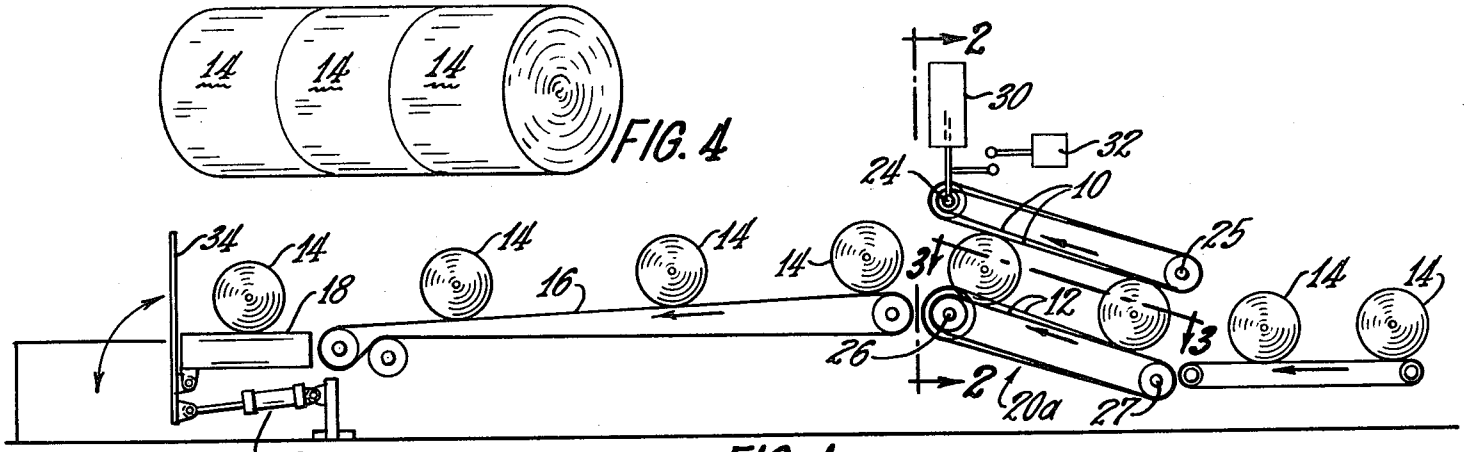
FIG. 1
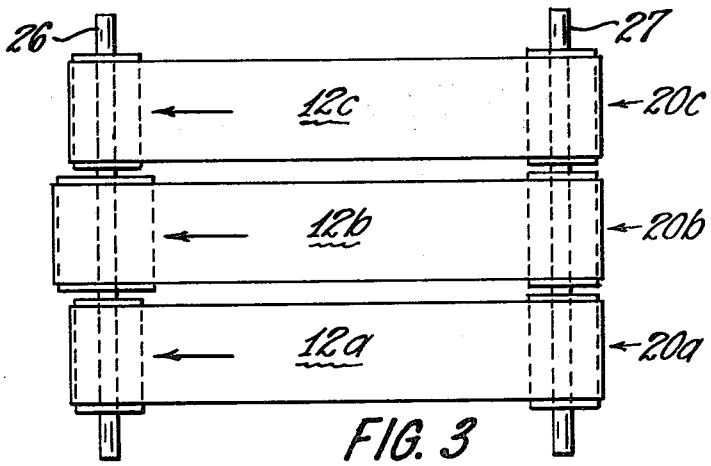
FIG. 3
FIG. 4
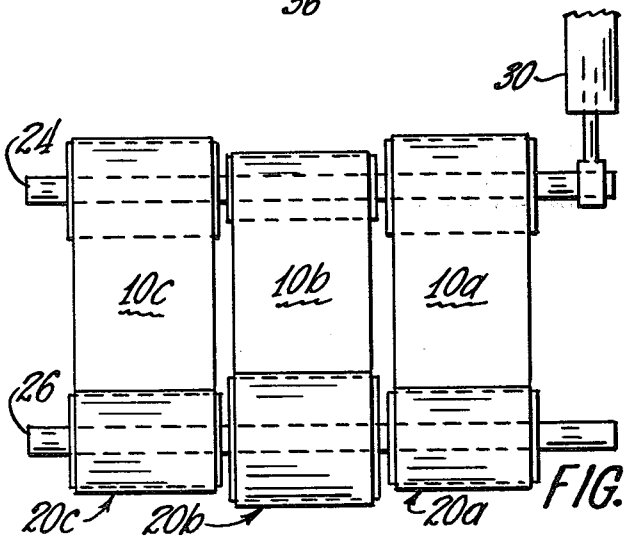
FIG. 2

METHOD AND APPARATUS FOR SEPARATING ROLLS OF WEB MATERIAL

TECHNICAL FIELD

This invention relates to handling rolls of web material of the type in which two or more rolls are attached at their side edges. In one of its more specific aspects, this invention relates to separating attached rolls of compressible material, such as rolls of glass fiber insulation.

BACKGROUND OF THE INVENTION

It is a common practice, when rolls of web material are packaged, for a plurality of rolls to be rolled up on the same machine and at the same time. For example, rolls of compressible insulation material, such as glass fiber insulation, are commonly rolled up two or more rolls at a time in a roll up machine. After the rolls are packaged in roll form, they are wrapped to contain the package in roll form during shipping.

One of the problems associated with roll packaging of multiple packages of web material is that it is sometimes difficult to separate the roll packages from each other subsequent to packaging. The problem of separating attached rolls is particularly acute where some misalignment has occurred during the roll up process resulting in "telescoping" of the packages. This problem is particularly troublesome where the web material is compressible material which is compressed during the roll up process. The problem of attached rolls requires extra labor and attention in packaging and shipping processes, since the attached rolls are typically separated by hand. Also, some rolls are attached to each other so firmly that they cannot be separated without destroying the web material. The method and apparatus of the invention are directed towards the solution of the problem of separating attached rolls of web material.

SUMMARY OF THE INVENTION

According to this invention, there is provided apparatus for separating rolls of web material of the type in which two or more rolls are attached at the side edges thereof, where the improvement comprises a first conveyor means having an upper and a lower conveyor defining a first path of travel for the first of the rolls, and additional conveyor means for each roll attached to the first roll, each additional conveyor means having an upper and a lower conveyor defining a path of travel for an attached roll, each of the paths being sufficiently vertically separated from its immediately adjacent path that the rolls passing therethrough are separated.

In a specific embodiment of the invention, the paths are vertically separated at the outlet end of the conveyor means, and not at the inlet end. The vertical separation of immediately adjacent paths can gradually increase from the inlet end to the outlet end of the conveyor means.

In another embodiment of the invention, the outlet ends of the upper conveyors are mounted for upward movement in response to the passage thereunder of attached rolls which have failed to separate. Means for sensing the upward movement of the outlet ends of the upper conveyors can be provided. Means for diverting unseparated rolls in response to the sensing of unseparated rolls can be provided.

In a preferred embodiment of the invention, the upper and lower conveyors are mounted at the inlet end of the conveyor means for travel around upper and lower end shafts, respectively, of uniform diameter, and the upper and lower conveyors are mounted at the outlet end of the conveyor means for travel around upper and lower end shafts, respectively, having different diameters corresponding to different paths of travel.

In another embodiment of the invention, the upper conveyors are adapted to drive the rolls in a direction opposite that of the lower conveyors. The lower conveyors can be adapted to travel at a speed greater than that of the upper conveyors.

According to this invention, there is also provided a method for separating rolls of web material of the type in which two or more rolls are attached at the side edges thereof, where the improvement comprises passing the first roll between an upper and lower conveyor defining a first path of travel, and simultaneously passing each attached roll between additional upper and lower conveyors defining a path of travel for each attached roll, where the path of travel for each roll is sufficiently vertically separated from its immediately adjacent path that the rolls passing therethrough are separated.

In a specific embodiment of the invention, the vertical separation between adjacent paths is gradually increased as the rolls travel between the conveyors.

In another embodiment of the invention, the passage between the conveyors of rolls which have failed to separate is sensed. The unseparated rolls can be diverted from the normal flow in response to the sensing of unseparated rolls.

In an additional embodiment of the invention, the rolls are driven by the upper conveyor in a direction opposite that of the lower conveyor. The lower conveyor can be driven at a speed greater than that of the upper conveyor.

DESCRIPTION OF THE DRAWINGS

FIG. 1 is a schematic view in elevation of the apparatus for separating rolls of web material according to the principles of this invention.

FIG. 2 is a schematic view in elevation of the outlet end of the upper and lower conveyors, taken along line 2—2 of FIG. 1.

FIG. 3 is a schematic plan view of the lower conveyors of the apparatus of FIG. 1, taken along line 3—3 of FIG. 1.

FIG. 4 is a schematic view of rolls of insulation material attached to each other.

DESCRIPTION OF THE INVENTION

As shown in FIG. 1, conveyor means 20a is adapted to receive insulation rolls 14. Two or more of the insulation rolls can be attached to each other, as shown in FIG. 4, and can be supplied from any suitable source, such as a Dyken machine or a belt roll up machine. After becoming separated by being passed through the conveyor means the insulation rolls can be transferred by any suitable means, such as transfer conveyor 16, to a means for handling the packaged, separated rolls, such as roll handling conveyor 18.

As shown in FIGS. 2 and 3, the apparatus is provided with two or more conveyor means, such as conveyor means 20a, 20b and 20c. Each conveyor means is comprised of upper conveyor 10 and lower conveyor 12 which define a path through which one of the insulation rolls passes at a time. The upper conveyors are mounted for travel about outlet upper conveyor shaft 24 and inlet upper conveyor shaft 25. The lower conveyors are mounted for travel about outlet lower conveyor shaft 26 and inlet lower conveyor shaft 27. The three conveyor means 20*a*, 20*b* and 20*c* are mounted adjacent each other so that attached insulation rolls can pass therethrough and each roll will travel on a path defined by a separate conveyor means. The paths defined by adjacent conveyor means are sufficiently vertically separated that the attached insulation rolls are broken apart from each other or separated during the passage of the rolls along the paths.

The vertical separation of the paths necessary for separation of the rolls can be accomplished by providing an unevenness in the upper and lower conveyor shafts at the outlet end of the conveyor means. The outlet conveyor shafts can be adapted with segments having different size diameters corresponding to the different conveyor means 20*a*, 20*b* and 20*c*. The outlet lower conveyor shaft can be adapted with a larger diameter segment for the 20*b* lower conveyor, for example, while the outlet upper conveyor shaft is adapted with larger diameter segments for the 20*a* and 20*c* lower conveyors, as shown in FIG. 2. In this manner, the path taken by any insulation roll traveling between the upper and lower conveyors will be vertically separated from any immediately adjacent path. In the best mode, as shown in FIG. 1, the separation between adjacent paths is gradually increasing from the inlet to the outlet of the conveyor means.

The outlet upper conveyor shaft can be mounted by any suitable means, such as shaft mount 30, for enabling the conveyor shaft to travel freely upward in the event attached rolls pass underneath without separating. Detector 32 can be adapted to sense the upward movement of the shaft and, therefore, the passage of unseparated rolls thereunder. The apparatus of the invention can be adapted with an appropriate safety mechanism, such as safety gate 34 and release mechanism 36, which can be activated upon the sensing of the passage of attached rolls, to divert the defective packages from the normal flow of packages by preventing the attached rolls from being transferred onto the roll handling conveyor.

The upper and lower conveyors can be driven by the inlet upper and lower conveyor shafts, which are themselves driven by motors, not shown. The upper conveyor can be adapted to drive the insulation rolls back toward the inlet end of the conveyor means, which is in a direction opposite that in which the rolls are driven by the lower conveyor. Where the lower conveyor travels at a speed faster than the upper conveyor, this arrangement merely increases the time during which the rolls are within the conveyor means.

EXPLOITATION IN INDUSTRY

This invention will be found to be useful in the packaging of insulation blankets of glass fibers used for thermal insulation products.

I claim:

1. Apparatus for separating rolls of web material of the type in which two or more rolls are attached at the side edges thereof, wherein the improvement comprises:

a first conveyor means having an upper and a lower conveyor defining a first path of travel for the first of said rolls; and additional conveyor means for each roll attached to said first roll, each additional conveyor means having an upper and a lower conveyor defining a path of travel for an attached roll, each of said paths being vertically aligned at the inlet end of the conveyor, and each of said paths being sufficiently vertically separated from its immediately adjacent path at the outlet end of the conveyor, that the rolls passing therethrough are separated.

2. The apparatus of claim 1 in which the vertical separation of immediately adjacent paths gradually increases from the inlet end to the outlet end of said conveyor means.

3. The apparatus of claim 2 in which the outlet ends of said upper conveyors are mounted for upward movement in response to the passage thereunder of rolls which have failed to separate.

4. The apparatus of claim 3 comprising means for sensing said upward movement.

5. Apparatus for separating rolls of compressible material of the type in which two or more rolls are attached at the side edges thereof, wherein the improvement comprises:

a first conveyor means having an upper and a lower conveyor defining a first path of travel for the first of said rolls; and additional conveyor means for each roll attached to said first roll, each additional conveyor means having an upper and a lower conveyor defining a path of travel for an attached roll; where said upper and lower conveyors are mounted at the inlet end of said conveyor means for travel around upper and lower end shafts, respectively, of uniform diameter;

and said upper and lower conveyors are mounted at the outlet end of said conveyor means for travel around upper and lower end shafts, respectively, having different diameters corresponding to different paths of travel, where each path is sufficiently vertically separated at the outlet end from its immediately adjacent path that said rolls passing therethrough are separated.

6. The apparatus of claim 5 in which the upper end shaft at the outlet end is mounted for upward movement in response to the passage thereunder of rolls which have failed to separate.

7. The apparatus of claim 6 comprising means for sensing said upward movement.

8. The apparatus of claim 7 comprising means for diverting said rolls which have failed to separate from the normal flow in response to said means for sensing upward movement.

9. The apparatus of claim 5 in which said upper conveyors are adapted to drive said rolls in a direction opposite that of said lower conveyors.

10. The apparatus of claim 9 in which said lower conveyors are adapted to travel at a speed greater than that of said upper conveyors.

11. The method for separating rolls of web material of the type in which two or more rolls are attached at the side edges thereof wherein the improvement comprises:

passing the first roll between an upper and lower conveyor defining a first path of travel; and simultaneously passing each attached roll between additional upper and lower conveyors defining a path of travel for each attached roll, where the paths of travel of all the rolls are vertically aligned at the inlet end of the conveyors, and where the path of travel for each roll is sufficiently vertically separated from its immediately adjacent path at the outlet end of the conveyors that the rolls passing therethrough are separated.

12. The method of claim 11 comprising gradually increasing the vertical separation between adjacent paths as the rolls travel between the conveyors.

13. The method of claim 12 comprising sensing the passage between the conveyors of rolls which have failed to separate.

14. The method of claim 13 comprising diverting said rolls which have failed to separate from the normal flow in response to said sensing.

15. A method for separating rolls of compressible material of the type in which two or more rolls are attached at the side edges thereof, wherein the improvement comprises:

passing the first of said rolls along a path defined by an upper and lower conveyor; and simultaneously passing each attached roll between additional upper and lower conveyors defining different paths of travel for the attached rolls, where each roll is passed along a path which is sufficiently vertically separated from immediately adjacent paths at the outlet end of the conveyors to separate the attached rolls; and driving said rolls by said upper conveyor in a direction opposite that of said lower conveyor.

16. The method of claim 15 comprising driving said lower conveyor at a speed greater than that of said upper conveyor.

* * * * *